US005451246A

United States Patent [19]

Wells

[11] Patent Number: 5,451,246

[45] Date of Patent: Sep. 19, 1995

[54] PROCESS AND DEVICE FOR HEATING AND MELTING LUMPS OF SPONGE IRON

[75] Inventor: William Wells, Exeter, England

[73] Assignee: Kortec AG, Zug, Switzerland

[21] Appl. No.: 185,900

[22] PCT Filed: May 21, 1993

[86] PCT No.: PCT/EP93/01290

§ 371 Date: Mar. 18, 1994

§ 102(e) Date: Mar. 18, 1994

[87] PCT Pub. No.: WO93/23575

PCT Pub. Date: Nov. 25, 1993

[30] Foreign Application Priority Data

May 21, 1992 [DE] Germany ..... 42 16 891.0

[51] Int. Cl.[6] ..... C21B 11/00

[52] U.S. Cl. ..... 75/380; 75/381; 75/384; 75/385; 75/523; 266/78; 266/81; 266/87; 266/144; 266/217

[58] Field of Search ..... 266/78, 87, 144, 81, 266/217; 75/380, 385, 573, 381, 384, 523

[56] References Cited

U.S. PATENT DOCUMENTS 3,702,242 11/1972 Fernandes ..... 266/900

FOREIGN PATENT DOCUMENTS 0063924A 11/1982 European Pat. Off. .
0192912A 9/1986 European Pat. Off. .
3421878A 12/1985 Germany .

*Primary Examiner*—Melvyn Andrews
*Attorney, Agent, or Firm*—Lahive & Cockfield

[57] ABSTRACT

For heating sponge iron to temperatures of about 850° C. without substantial oxidation losses, there are provided at least two separate preheating stages at different temperatures, to which the sponge iron is successively fed and in which the temperature and the gas atmosphere are respectively individually controlled in such a way that a chemically neutral gas atmosphere is set in the first preheating stage at the lowest temperature and a reducing gas atmosphere is set in the last preheating stage at the highest temperature. The hot gas for the preheater is obtained at least in part from the waste gas from the melting furnace, to which the preheated sponge iron is fed.

16 Claims, 1 Drawing Sheet

PROCESS AND DEVICE FOR HEATING AND MELTING LUMPS OF SPONGE IRON

BACKGROUND OF INVENTION

The invention relates to a process and an apparatus for heating and melting lumps of sponge ion.

In a known process of the specified kind, metallic iron carriers are heated in a charging material preheater arranged above a melting furnace, and then fed to the furnace. In that case, an economical mode of operation is only possible if the iron carriers used are materials which do not involve excessive reactivity in relation to oxygen, as it is only then that the energy content of the waste gases from the melting furnace can be economically used for the preheating effect, by virtue of post-combustion of the waste gases. If directly reduced material in lump form, that is to say sponge iron in lump form, is to be preheated, then its high level of reactivity, in particular at temperatures above 500° C., requires a reducing atmosphere in order to prevent major oxidation losses when the sponge iron is heated. For that purpose, the sponge iron has been heated, mixed with coke, in a preheater. However such a process necessitates a considerable surplus of energy-rich waste gases and presupposes gas consumers in the vicinity of the installation.

The invention is based on the problem of permitting preheating of the highly reactive sponge iron to temperatures of about 850° C. without substantial oxidation losses, and at the same time avoiding a surplus of energy-rich waste gases. The invention also seeks to provide an apparatus for carrying out that process.

SUMMARY OF THE INVENTION

The process according to the invention is characterised by the features of claim 1. Advantageous configurations of the process are set forth in claims 2 to 9. The apparatus according to the invention is characterised by the features of claim 10. Advantageous embodiments of that apparatus are described in the remaining claims.

In the case of the process according to the invention, the different level of reactivity of sponge iron at temperatures of different levels is utilised by virtue of the fact that the operation of preheating the sponge iron is carried out in a plurality of stages and a given temperature and a given gas atmosphere is associated with each of the preheating stages. While the sponge iron can only be heated with reducing gases at high temperatures of 800° to 900° C., it is possible to heat the sponge iron in a neutral atmosphere in preheating stages at a lower temperature such as 250° C. or 500° C. A substantial increase in the level of economy of the process can be achieved by suitable individual control of the temperature and the gas atmosphere in the individual preheating stages. By means of the apparatus according to the invention, subdivision into different preheating stages and control of the temperature and the gas atmosphere in those preheating stages can be achieved in a fashion which is particularly simple from the structural point of view.

DETAILED DESCRIPTION

Figure 1:
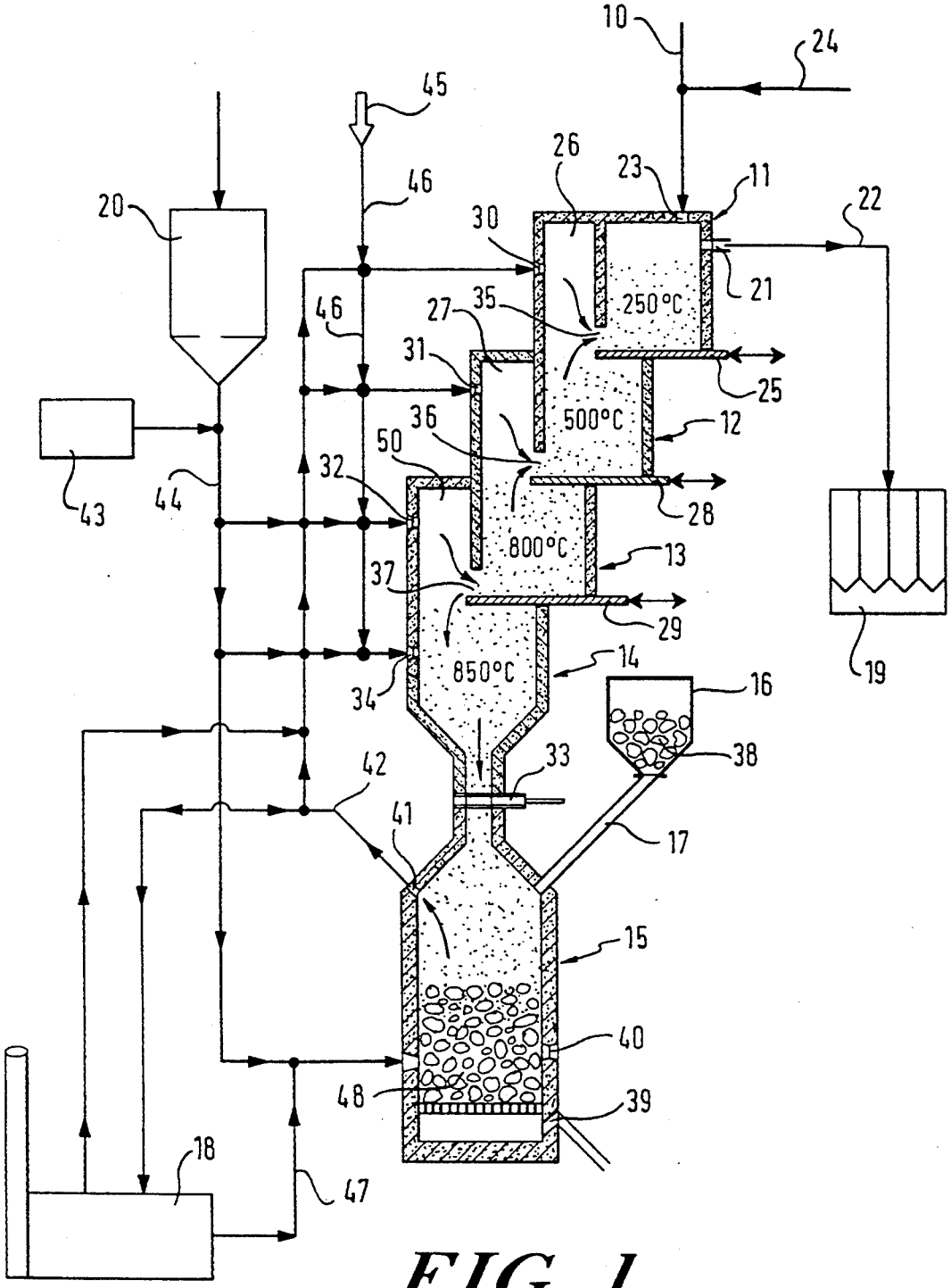
FIG. 1 shows a diagrammatic view of the individual steps in the process of an embodiment of the invention.

FIG. 1 diagrammatically shows a process for melting sponge iron 10, with four preheating chambers 11 to 14 which are arranged one above the other and which are lined with refractory material, a transportably designed cupola furnace 15 arranged beneath the fourth preheating chamber 14, a coke store 16 with a feed conduit 17 to the cupola furnace 15, a recuperator 18, a gas cleaning installation 19 and a coal store 20.

The first preheating chamber 11 is of a rectangular configuration and has a gas outlet 21 which is connected by way of a conduit 22 to the gas cleaning installation 19, and a charging opening 23 through which sponge iron 10 and limestone 24 can be introduced into the first preheating chamber 11. The floor of the first preheating chamber 11 is mounted slidably and is in the form of a slider 25 for opening and closing of the preheating chamber 11 in order to pass predetermined amounts of sponge iron 10 and limestone 24 directly into the subjacent preheating chamber 12.

Furthermore, the preheating chamber 12 is stepped in the upper region and is also of a rectangular configuration.

The stepped configuration of the preheating chamber forms a gas space 26, that is to say a region which is free of solid material, in the preheating chamber 12.

The third and fourth preheating chambers 13 and 14 are of a configuration corresponding to the second preheating chamber 12, that is to say they are also stepped and have a slider 28 and 29 respectively as an intermediate floor member between the chambers 12/13 and 13/14 respectively. The sliders 25, 28 and 29 respectively are slidable as a maximum over the width of the respective subjacent step so that, through the opening formed by the sliding movement of the respective slider 25, 28 and 29 respectively, the sponge iron 10 and the limestone 24 can drop or be discharged into the respective subjacent preheating chamber 12, 13 and 14 respectively. Accordingly, the flow of material from the first into the fourth preheating chamber 11, 14 is controllable by way of the sliders 25, 28 and 29.

The fourth preheating chamber 14 does not have a slider. On the contrary, it tapers in its lower region and is connected to the cupola furnace 15 by way of a metering flap 33. The preheating chambers 12, 13 and 14 are each provided with a respective burner 30, 31 and 32 opening into the associated gas space 26, 27 and 50 of the respective preheating chamber. In addition the fourth preheating chamber 14 has a further burner 34 in its lower half.

The preheating chambers 11 to 14 are arranged directly one above the other and in offset relationship. In that respect, the third preheating chamber 13 is mounted on the lower step of the fourth preheating chamber 14, the second preheating chamber 12 is mounted on the lower step of the third preheating chamber 13 and the first preheating chamber 11 is mounted on the lower step of the second preheating chamber 12. The preheating chambers 11 to 13 have gas inlets 35, 36 and 37 respectively which are each arranged directly above the respective slider 25, 28 and 29 in the adjoining side wall of the adjacent stepped preheating chamber 12, 13 or 14 respectively.

The cupola furnace 15 is of a known design configuration with a coke bed 48 which can be replenished with coke 38 from the coke store 16 by way of the feed conduit 17.

The cupola furnace 15 also has a tapping opening 39, burner 40 and a waste gas opening 41. The latter is connected by way of a conduit 42 to the recuperator 18 and to the burners 30 to 32 and 34 in such a way that the waste gas from the cupola furnace 15 can be passed in a controllable ratio, in part to the recuperator 18 and in part to the burners 30 to 32 and 34. About 40 to 80% of the waste gas is passed into the recuperator 18 for heating the combustion air to about 815° C., and the remainder goes to the burners.

In addition the coal store 20 and an oxygen source 43 are connected by way of conduits 44 to the respective burners 30 to 32, 34 and 40. Air 45 can be supplied to the burners 30 to 32 and 34 by way of a conduit 46.

The air which is preheated in the recuperator 18 is fed to the burner 40 by way of a conduit 47. The air can be blown into the cupola furnace together with coal from the coal store 20, to reduce the consumption of coke.

Lime and/or preheated air or coal can be introduced in the required amount, by way of the burners 30 to 32, 34 and 40. Instead of or in addition to coal however it is also possible for other fossil fuels such as natural gas, oil or synthetic fuels to be introduced into the preheating chambers 12 to 14 or the cupola furnace 15.

In addition, the waste gas from the cupola furnace 15 can be fed to the preheating chambers 12 to 14 by means of the burners 30 to 32, 34 and the conduit 42.

The described and illustrated apparatus is intended for heating and melting sponge iron 10 which is highly reactive with oxygen, by means of fossil fuels, in order to produce liquid iron with a carbon content of over 3% and at a temperature of over 1400° C.

In that connection, for example 1075 kg of sponge iron 10 is required per 1000 kg of iron produced. The sponge iron 10 is of a typical composition of from 85 to 90% of metallic iron, 0.5% carbon and 10% iron oxide. The sponge iron 10 together with limestone 24 is introduced into the first preheating chamber 11 by way of the charging opening 23. In that situation, preferably 115 kg of limestone is added per tonne of iron produced.

By virtue of the arrangement of the cupola furnace 15 and the preheating chambers 11 to 14 one above the other, the mixture consisting of sponge iron 10 and limestone 24 can drop into the respectively subjacent preheating chamber 12, 13 and 14, when the respective slider 25, 28 and 29 is opened. When that happens, the amount which is to be discharged into the next preheating chamber 12, 13 and 14 is controlled by means of the displacement travel of the slider 25, 28 or 29 respectively, and the period of time for which the slider 25, 28 or 29 remains in the opened position.

Then, by the metering flap 33 being opened, a predetermined weighed amount of preheated sponge iron 10 and the lime passes from the fourth preheating chamber 14 into the cupola furnace 15.

Neutral conditions, that is to say neither oxidising nor reducing conditions, obtain in the first preheating chamber 11. Here, the sponge iron 10 and the limestone 24 are heated to 250° C. by the hot gases which flow out of the preheating chamber 12 and which flow in through the gas inlet 35. In that situation, the gas flows through the loose fill comprising limestone 24 in lump form and sponge iron 10 in lump form introduced into the first preheating chamber 11, and delivers heat to the sponge iron 10 and the limestone 24. The gas is passed by way of the gas outlet 21 and the conduit 22 to the gas cleaning installation where it is cleaned.

The temperature and the atmosphere, that is to say the gas composition in the individual preheating chambers 11 to 14, are ascertained by temperature measuring and gas analysing devices which are not shown here. The neutral/reducing conditions in the individual preheating chambers 11 to 14 can then be set and maintained or altered, by means of the burners 30 to 32 and 34. In that respect, that control operation is computer-aided in known manner.

According to the requirements in the individual preheating chambers 11 to 14, waste gas from the cupola furnace 15 is injected by the burners 30 to 32 and 34 into the preheating chambers 12, 13 and 14 respectively, directly or after being cooled down by way of the recuperator 18. In addition the burners 30 to 32 and 34 can burn coal with air 45 and/or oxygen in order additionally to heat the preheating chambers 12, 13 and 14.

The sponge iron 10 and the limestone 24 are heated to about 250° C. in the first preheating chamber 11, to about 500° C. in the second preheating chamber 12, to about 800° C. in the third preheating chamber 13 and to about 850° C. in the fourth preheating chamber 14.

Heating takes place under reducing conditions in the third and fourth preheating chambers 13 and 14, by waste gas being suitably passed from the cupola furnace 15 into the preheating chambers 12 and 13. In that respect, the proportion of carbon monoxide in the gas mixture $CO_2+CO$ should be over 25%.

By the time it reaches the fourth preheating chamber 14, the limestone 24 has been converted into lime and then serves in the cupola furnace 15 as a fluxing agent for the molten sponge iron 10.

The heated sponge iron 10 and the lime are then introduced into the cupola furnace 15 by means of the metering flap 33. The cupola furnace 15 is provided with a coke bed 48, the coke 38 being of a size of up to about 20 cm.

Hot air which has been preheated to 850° C. by the recuperator is blown into the coke bed 48 in the cupola furnace 15 by way of the burner 40. As a result of the energy which is liberated in that way, the sponge iron and the lime melt and flow jointly through the coke bed 48. When the molten material passes downwardly through the coke bed 48, the temperature of the molten material further rises and carbon is dissolved in the iron. The molten material then collects at the base of the cupola furnace 15, the molten material being of a composition of over 3% carbon and over 95% pure iron. The molten material can then be discharged from the cupola furnace 15 by way of the tapping hole 39, for further processing.

The amount of coke which is required for the process is about 175 kg per tonne of iron produced. The amount of coke 38 which is required for the process can be reduced if coal is additionally used for heating purposes, either in the cupola furnace 15 or also in the preheating chambers 12 to 14.

The amount of coke can further be reduced to 80 to 100 kg per tonne by the combustion procedures being assisted with oxygen and additional fuels such as coal, natural gas, oil or synthetic fuels.

I claim:

1. A process for heating and melting sponge iron in lump form, including the steps of charging the sponge iron into a preheater, heating the sponge iron by passing hot gases through the sponge iron in a heat exchange relationship, passing the sponge iron from the preheater on to a coke bed heated by means of oxygen or hot air in a melting furnace and there melting the sponge iron to form a molten material, and passing the molten material through the coke bed and collecting the molten material in a lower part of the melting furnace, wherein the hot gas for the preheater is at least partially obtained from a waste gas of the melting furnace, characterised by the step of heating the sponge iron in the preheater in at least two separate preheating stages at different temperatures including a first lower temperature and a second higher temperature, and controlling the temperature and the gas atmosphere respectively and individually by controlling the temperature and the composition of the hot gases which are introduced into the preheating stages, to achieve a chemically neutral gas atmosphere in the first preheating stage at the lower temperature and a reducing gas atmosphere in the last preheating stage at higher temperature.

2. A process according to claim 1 characterised in that the reducing gas atmosphere contains CO and $CO_2$ gas in the ratio:

$$\frac{CO}{CO_2 + CO} > 25\%.$$

3. A process according to claim 1 characterised in that, when there are more than two preheating stages with different stepped temperature values, the ratio $$\frac{CO}{CO_2 + CO}$$

is set to a value which rises with the temperature value.

4. A process according to claim 1 characterised in that there are provided four preheating stages in which approximately the following temperatures are set:

Stage 1: 250° C.,

Stage 2: 500° C.,

Stage 3: 800° C., and

Stage 4: 850° C.

5. A process according to claim 1 characterised by the further step of generating hot gases in a preheating stage at higher temperature and partially introducing said hot gases into a preheating stage at lower temperature.

6. A process according to claim 5 characterised in that the hot gases are mixed with additional gases before being introduced into the preheating stage at lower temperature, to control the temperature and the gas atmosphere of said preheating stage.

7. A process according to claim 1 characterised in that the waste gas from the melting furnace is introduced into the individual preheating stages, and control of temperature and gas atmosphere in the individual preheating stages is effected by adding the waste gas from the melting furnace, which has been cooled in a recuperator, and partially combusting said waste gas or an additional fuel with an oxygen-bearing gas.

8. A process according to claim 1 characterised in that air is preheated in a recuperator to generate hot air, and the hot air is fed to a combustion zone of the coke bed of the melting furnace.

9. A process according to claim 1 characterised in that sponge iron in lump form is heated jointly with limestone in the preheater and then fed to the melting furnace.

10. A process according to claim 7 wherein said oxygen bearing gas includes air.

11. Apparatus for heating and melting sponge iron in lump form, comprising a preheater having a top, a bottom and sidewalls and being arranged above a melting furnace, said top having a charging means for charging the sponge iron into the preheater and a gas outlet, said bottom having a discharge means for the discharge of the heated sponge iron from the preheater into the melting furnace, and at least one of the side walls having nozzles and/or burners for the introduction of hot gases into the preheater, said preheater further including at least two preheating chambers which are respectively arranged one above the other, wherein the uppermost chamber includes the gas outlet and the charging means for the sponge iron and the lowermost chamber contains the discharge means, said preheater further including, between two adjacent chambers, an intermediate discharge means for the discharge of sponge iron from one chamber into the other chamber and including a gas inlet for the introduction of gas from one chamber to the other chamber, wherein the gas inlet communicates with a gas space into which at least one nozzle and/or burner opens.

12. Apparatus according to claim 11 characterised in that the preheating chambers of the preheater have a rectangular cross-section and are arranged as an upper and lower chamber and further arranged in a mutually laterally offset relationship to define said gas space in said lower chamber at a corner of said rectangular cross-section thereof.

13. Apparatus according to claim 11 characterised in that the intermediate discharge means includes a sliding bottom member disposed between adjacent preheating chambers.

14. Apparatus according to claim 11 characterised in that the gas inlets are formed by a gap between two of said preheating chambers.

15. Apparatus according to claim 11 characterised in that the discharge means of the lowermost preheating chamber includes a metering flap.

16. Apparatus according to claim 11 characterised in that associated with each preheating chamber are at least one temperature sensor and at least one gas sensor for individual control of the temperature and gas atmosphere in the respective preheating chamber.

* * * * *